US005996473A

United States Patent [19]

Milone

[11] Patent Number: 5,996,473

[45] Date of Patent: Dec. 7, 1999

[54] BEVERAGE INFUSION DEVICE

[75] Inventor: Henry S. Milone, New York, N.Y.

[73] Assignee: JSD Partners, Waterbury, Conn.

[21] Appl. No.: 09/124,097

[22] Filed: Jul. 29, 1998

Related U.S. Application Data

[63] Continuation of application No. 08/728,827, Oct. 10, 1996, Pat. No. 5,809,868.

[51] Int. Cl.[6] ..... B65D 25/04

[52] U.S. Cl. ..... 99/323; 99/494; 99/279; 99/287

[58] Field of Search ..... 99/323, 279, 287, 99/485, 494

[56] References Cited

U.S. PATENT DOCUMENTS

| | | | |
|---|---|---|---|
| 1,489,806 | 4/1924 | Anderson | 99/323 |
| 2,741,976 | 4/1956 | Faber | 99/323 X |
| 2,867,536 | 1/1959 | Mead et al. . | |
| 3,102,465 | 9/1963 | Montesano | 99/323 |
| 3,193,388 | 7/1965 | Conrey . | |
| 3,615,595 | 10/1971 | Guttag . | |
| 4,215,628 | 8/1980 | Dodd, Jr. | 99/323 |
| 4,410,550 | 10/1983 | Gaskill | 426/80 |
| 4,651,870 | 3/1987 | Giambalvo | 206/0.5 |
| 4,860,929 | 8/1989 | Lowe et al. | 222/189 |
| 4,986,451 | 1/1991 | Lowe et al. | 222/189 |
| 5,047,252 | 9/1991 | Liu et al. | 426/79 |
| 5,076,425 | 12/1991 | Plone | 206/220 |
| 5,440,976 | 8/1995 | Giuliano et al. | 99/485 |
| 5,623,865 | 4/1997 | Sidiropoulos | 99/323 |

*Primary Examiner*—Reginald L. Alexander
*Attorney, Agent, or Firm*—DeLio & Peterson LLC; Robert Curcio

[57] ABSTRACT

The device of the present invention enables the infusion of a beverage. Further, the device provides for compact storage and disposal and provides structure for stirring the beverage. In the preferred embodiment the beverage infusion device comprises a substantially tubular handle having a bore therethrough and a substantially tubular body comprising coaxial inner and outer walls. The body is movably disposed in the handle. The body has three rectangular infusion openings on the outer wall to facilitate the cross-flow of a beverage through three porous pouches. The inner wall and the outer wall defining a region wherein the rectangular porous pouches containing an infusible beverage substance are positioned in cooperation with the rectangular infusion openings. The body outer wall having first and second ends and wherein a flange is formed near the first end of the outer wall. The handle having first and second ends and first and second detents on the handle first end, the second detent being deeper than the first detent. A space is defined between the detents. The flange rests in the space between the first and second detents.

10 Claims, 7 Drawing Sheets

BEVERAGE INFUSION DEVICE

This is a continuation of application Ser. No. 08/728,827 filed on Oct. 10, 1996 now U.S. Pat. No. 5,809,868.

BACKGROUND OF THE INVENTION

1. Field of the Invention

The present invention relates to a device for producing a beverage from an infusible beverage substance and, in particular, to a portable beverage infusion device for preparing a single serving beverage.

2. Description of Related Art

Conventional methods of infusible beverage preparation include the common tea bag which is a pouch of porous filter material containing an infusible beverage substance with a string attached to the pouch. While the common name for the device is "tea" bag, the infusible beverage substance contained therein can be dry roasted coffee, tea, herbal medicines or the like. Stirring an infused beverage by use of the common tea bag is not satisfactory because the string lacks the rigidity necessary to provide an adequate stirring mechanism. Further, the removal of the tea bag from the beverage can be untidy since the wet tea bag can drip. In order to prevent the tea bag from dripping, the tea bag is often squeezed dry or placed in a paper towel or napkin prior to being discarded. Coffee is also infused in porous pouches with the same disadvantages.

Methods for infusing coffee, including the French press method, the vacuum method and the middle eastern or Turkish coffee method, require brewing devices which not portable and are best suited to making multiple cups of coffee. The French press requires a container device fitted with a plunger. The vacuum method requires a device with two glass chambers, e.g. upper and lower chambers. The middle eastern method requires a long handled narrow necked device called an ibrit. The aforementioned devices are fragile, large and inconvenient to carry; thus the average coffee drinker hoping to partake in an impromptu cup of coffee would not carry the devices during his or her daily travels.

Another method of coffee infusion is the cold water method. The method is time consuming and typically requires approximately 10–20 hours, a large bowl, two quarts of water and a pound of finely ground coffee to create a concentrated coffee liquid. The concentrated liquid must be added to hot water to create a cup of coffee. The method is time consuming and impractical for the coffee drinker desiring an impromptu cup of coffee.

U.S. Pat. No. 3,102,465 discloses a leak-proof packaging infusion unit. The unit comprises a tubular sheath element, a tubular charge holding element adapted to fit telescopically inside the sheath element and a circular closure cap. The closure cap is the structure which holds the infusible substance in the unit. The device only allows liquid to contact the infusible substance through the exterior of the charge holding element. Also, the device does not permit removal of excess liquid after use.

Bearing in mind the problems and deficiencies of the prior art, it is therefore an object of the present invention to provide a infusion device which is convenient to use.

It is another object of the present invention to provide an infusion device which is also a stirring device.

It is another object of the present invention to provide an infusion device which permits better contact with an infusible beverage substance.

It is another object of the present invention to provide an infusion device which removes excess liquid after use.

Still other objects and advantages of the invention will in part be obvious and will in part be apparent from the specification.

SUMMARY OF THE INVENTION

The above and other objects, which will be apparent to those skilled in the art, are achieved by the present invention which in a first aspect relates to a beverage infusion device. The beverage infusion device comprises a handle having a bore therethrough and a body comprising at least one inner wall surrounding a core and outer walls. The body is movably disposed in the handle. The inner wall and the outer wall define therebetween for an infusible beverage substance. The outer wall has a plurality of outer infusion openings to facilitate a cross-flow of a liquid through said region between said inner and outer walls.

In another aspect, the present invention relates to a beverage infusion device comprising a handle means having a bore therethrough and a body means comprising inner and outer walls. The body is movably disposed in the handle. The inner wall and the outer wall define a region wherein at least one porous pouch containing an infusible beverage substance is positioned. The outer wall has a plurality of outer infusion openings to facilitate a cross-flow of a liquid through the porous pouch.

In the preferred embodiment, the beverage infusion device comprises a substantially tubular handle having a bore therethrough and a substantially tubular body comprising coaxial inner and outer walls. The body is movably disposed in the handle. The body has three rectangular infusion openings on the outer wall to facilitate the cross-flow of a liquid through the pouch. The inner wall and the outer wall define a region wherein three rectangular porous pouches containing an infusible beverage substance are positioned in cooperation with the rectangular infusion openings. The body outer wall has first and second ends and wherein a flange is formed near the first end of the outer wall. The handle has first and second ends and first and second detents on the handle first end. The second detent are deeper than the first detent. A space is defined between the detents. The flange rests in the space between the first and second detents.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
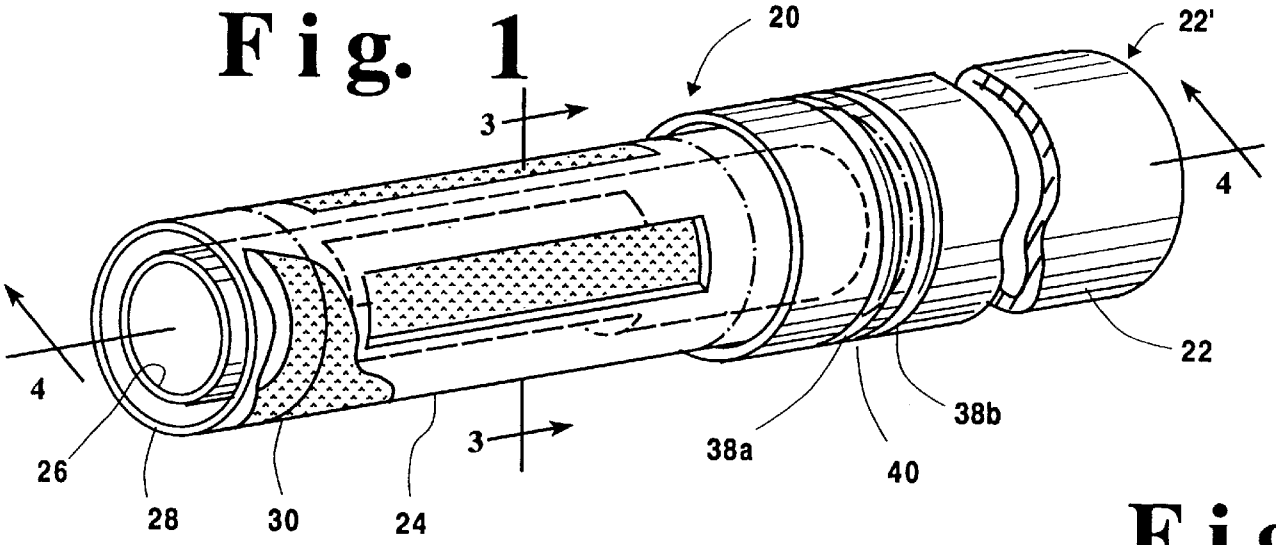
FIG. 1 is a perspective view of the beverage infusion device cutaway to show a porous pouch positioned between inner and outer walls of the body.

In describing the preferred embodiments of the present invention, reference will be made herein to FIGS. 1–12 of the drawings in which like numerals refer to like features of the invention. Features of the invention are not necessarily shown to scale in the drawings.

Figure 3:
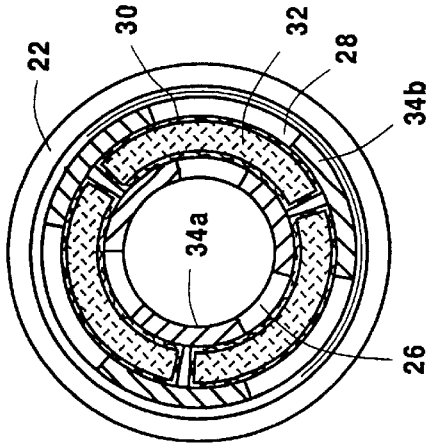
FIG. 3 is a cross-sectional view of the beverage infusion device, along line 3—3 of FIG. 1, illustrating the placement of the rectangular infusion openings in the body of the device and the rectangular infusion pouches.
Figure 3B:
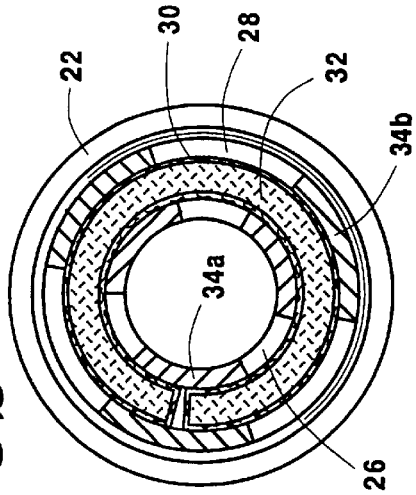
FIG. 3*b* a cross-sectional view of the beverage infusion device, along line 3—3 of FIG. 1, illustrating the placement of the rectangular infusion openings in the body of the device and the substantially rectangularly shaped infusion pouches.
Figure 3A:
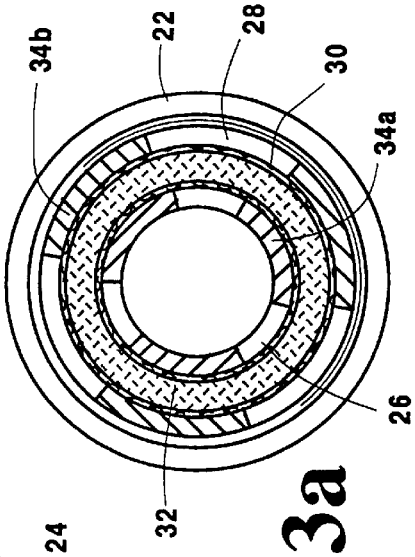
FIG. 3*a* is a cross-sectional view of the beverage infusion device, along line 3—3 of FIG. 1, illustrating the placement of the rectangular infusion openings in the body of the device and the substantially annularly shaped infusion pouches.
Figure 3C:
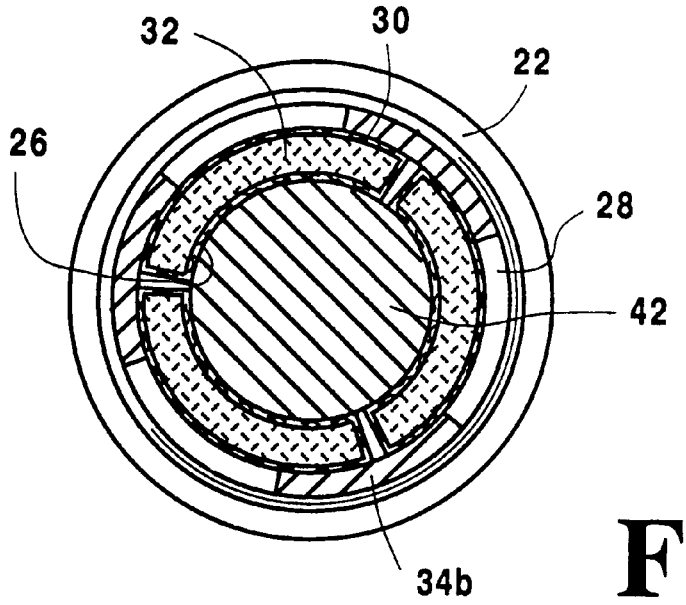
FIG. 3*c* is a cross-sectional view of the beverage infusion device, along line 3—3 of FIG. 1, illustrating a solid core defined by the inner wall.
Figure 5:
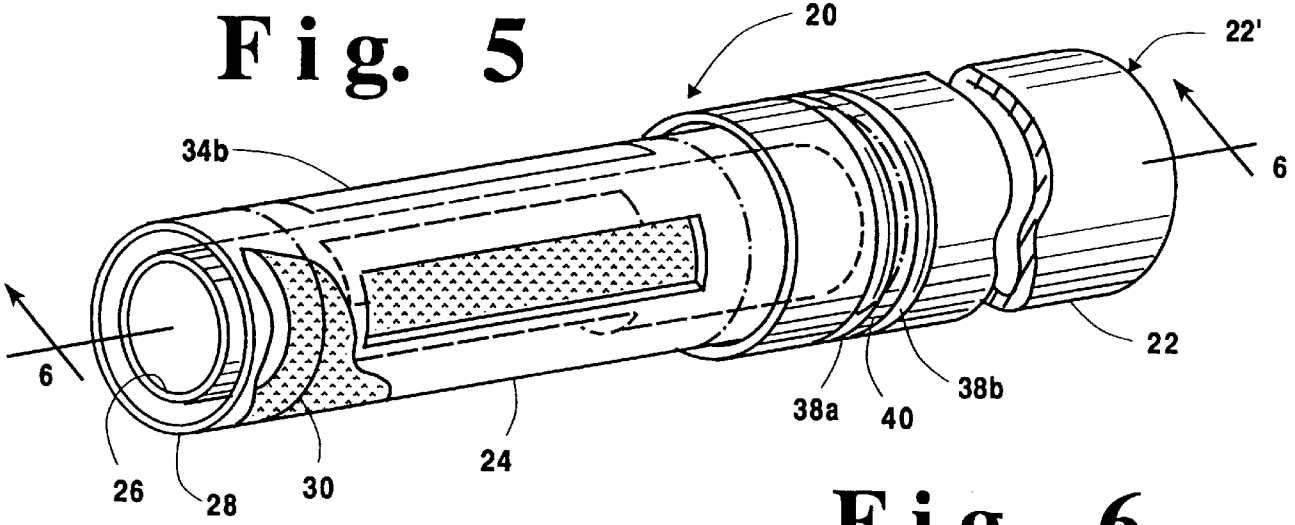
FIG. 5 is a perspective view of the beverage infusion device illustrating a porous pouch in one set of infusion openings and another set of infusion openings without a pouch.
Figure 6:
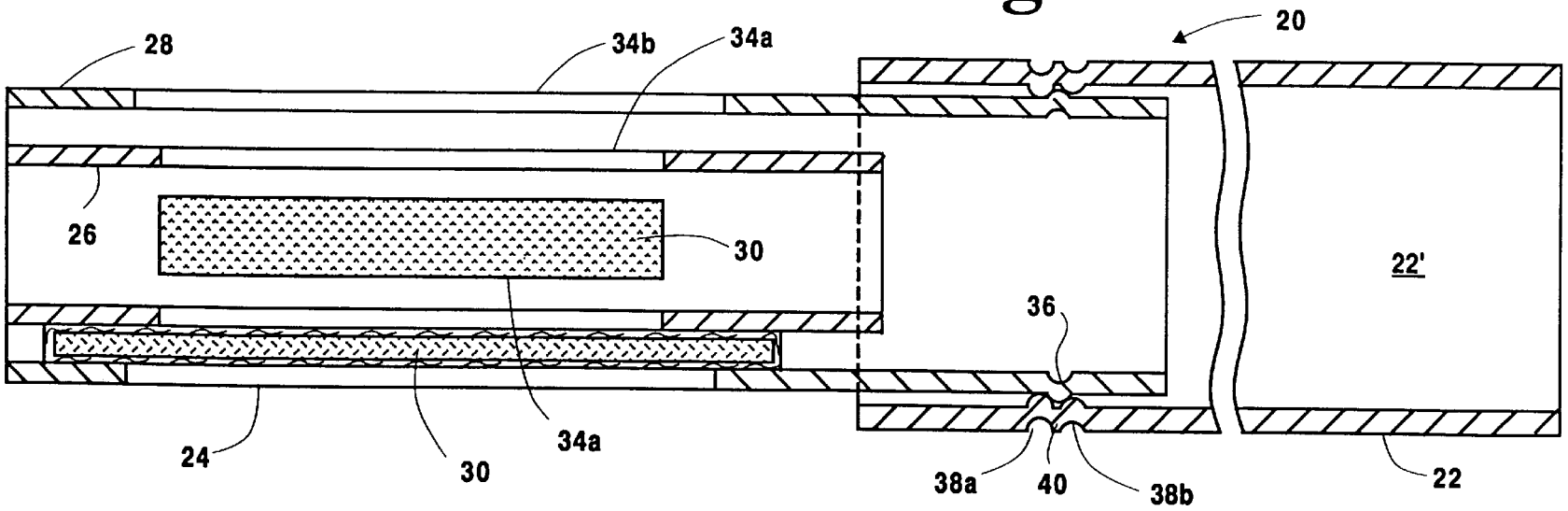
FIG. 6 is a cross sectional view of the beverage infusion device illustrating a porous pouch in one set of infusion openings and another set of infusion openings without a pouch.

A beverage infusion device 20 constructed in accordance with the present invention is shown in FIG. 1. The device comprises a handle 22 having a bore 22' therethrough, and a body 24 movably and slidably disposed in the handle 22. The handle 22 and the body 24 are coaxial. The body comprises at least one inner wall 26 and an outer wall 28 which define a region therebetween for an infusible beverage substance 32. In normal use, at least one porous pouch 30 is positioned in the region defined by the inner wall 26 and the outer wall 28. As illustrated in FIGS. 5–6, at least one set of infusion opening 34*a,b* may be empty, without a pouch occupying the openings 34*a,b* in order to facilitate the flow of liquid through the device 20. The preferred shape of the handle 22, the bore 22' and the body 24 is circular in cross-section as shown in FIG. 3, although the other cross-sectional shapes including triangular, rectangular, octagonal or square are possible. A core 42, defined by the inner wall 26, may be hollow or solid. Hollow cores are shown in FIGS. 3, 3*a*, 3*b*, and 3*d*. A solid core 42 is illustrated in FIG. 3*c*.

Figure 7:
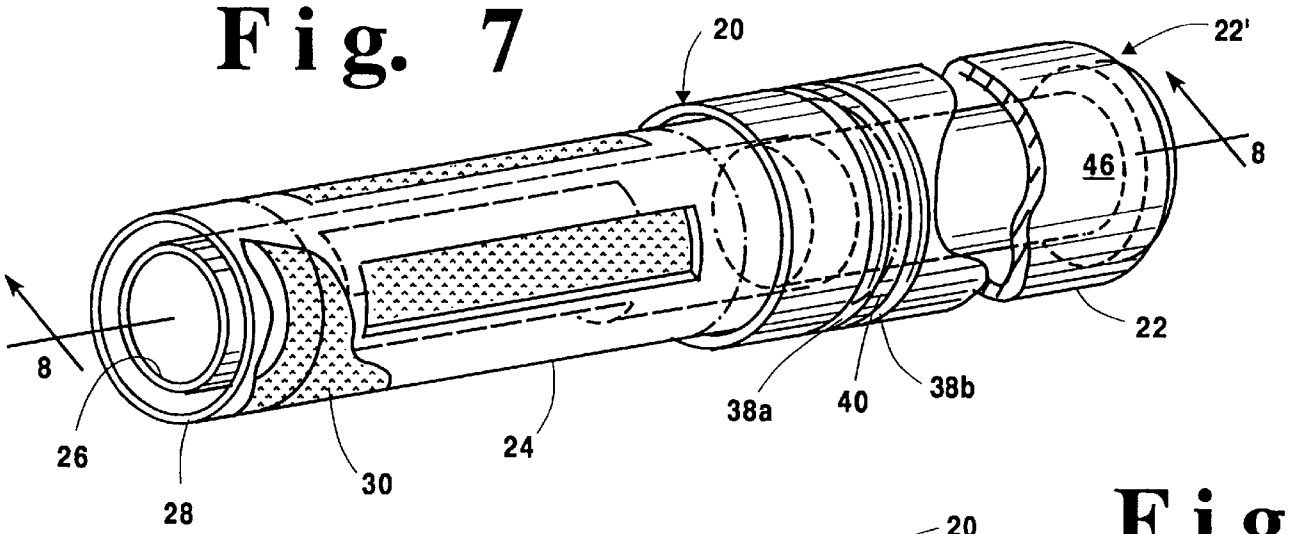
FIG. 7 is a perspective view of the beverage infusion device with a plunger snugly fit in the body inner wall.
Figure 8:
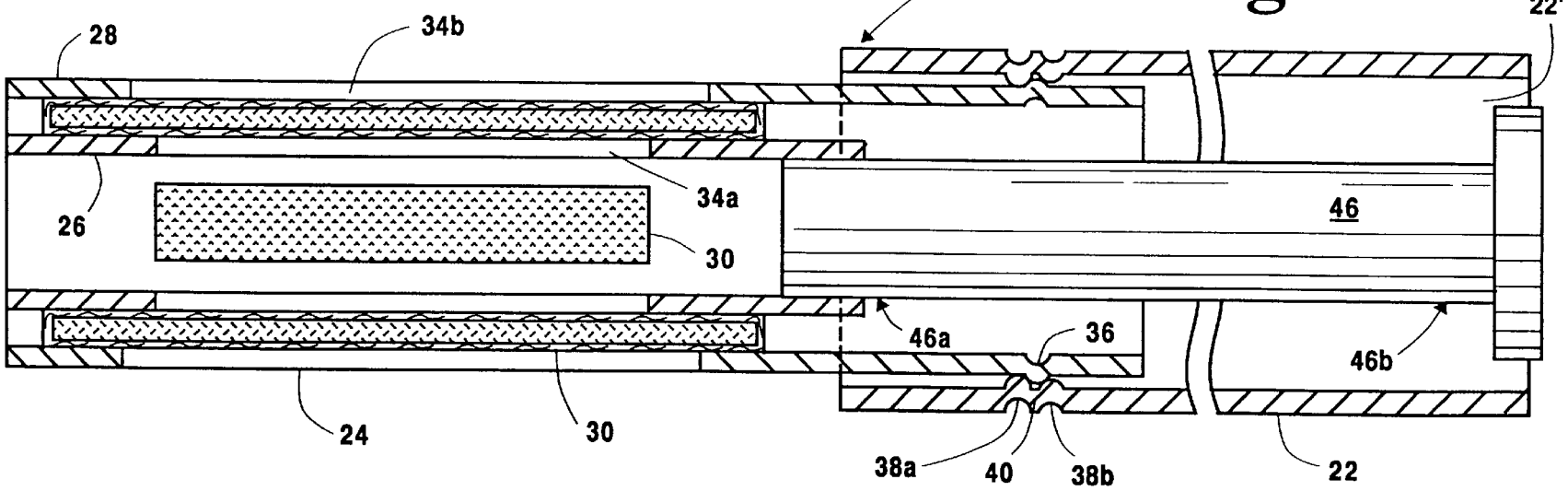
FIG. 8 is a cross sectional view of the beverage infusion device with a plunger snugly fit in the body inner wall.

Additionally, as illustrated in FIGS. 7–8, a plunger 46 having first and second ends 46*a,b* and being axially aligned with the core 42 may be movably or slidably received at the first end in the body inner wall 26. The outer diameter of the plunger 46 should be substantially the same as the inside diameter of the body inner wall 26 so as to provide a sliding fit. The plunger 46 should have substantially the same shape as the body inner wall 26, with the preferred cross-section being circular. The plunger 46 can operate to push the liquid out of the core 42. Alternately, the plunger may be tapered. The first end of the plunger is received by the body inner wall and has a diameter which is smaller than the diameter of the second end. In the tapered embodiment the plunger can operate to push the liquid out of the core and also to apply pressure to the infusible beverage substance positioned in the device. When the beverage infusion device 20 is in the closed position, a substantial portion of the plunger 46 is positioned in the body inner wall 26. When the beverage infusion device 20 is in the extended position, a small portion of the plunger 46 remains positioned in the body inner wall 26. The plunger 46 may be used to remove liquid from the extended infusion device 20 by using a pushing motion to push the plunger 46 into the core 42 defined by the body inner wall 26.

Figure 2:
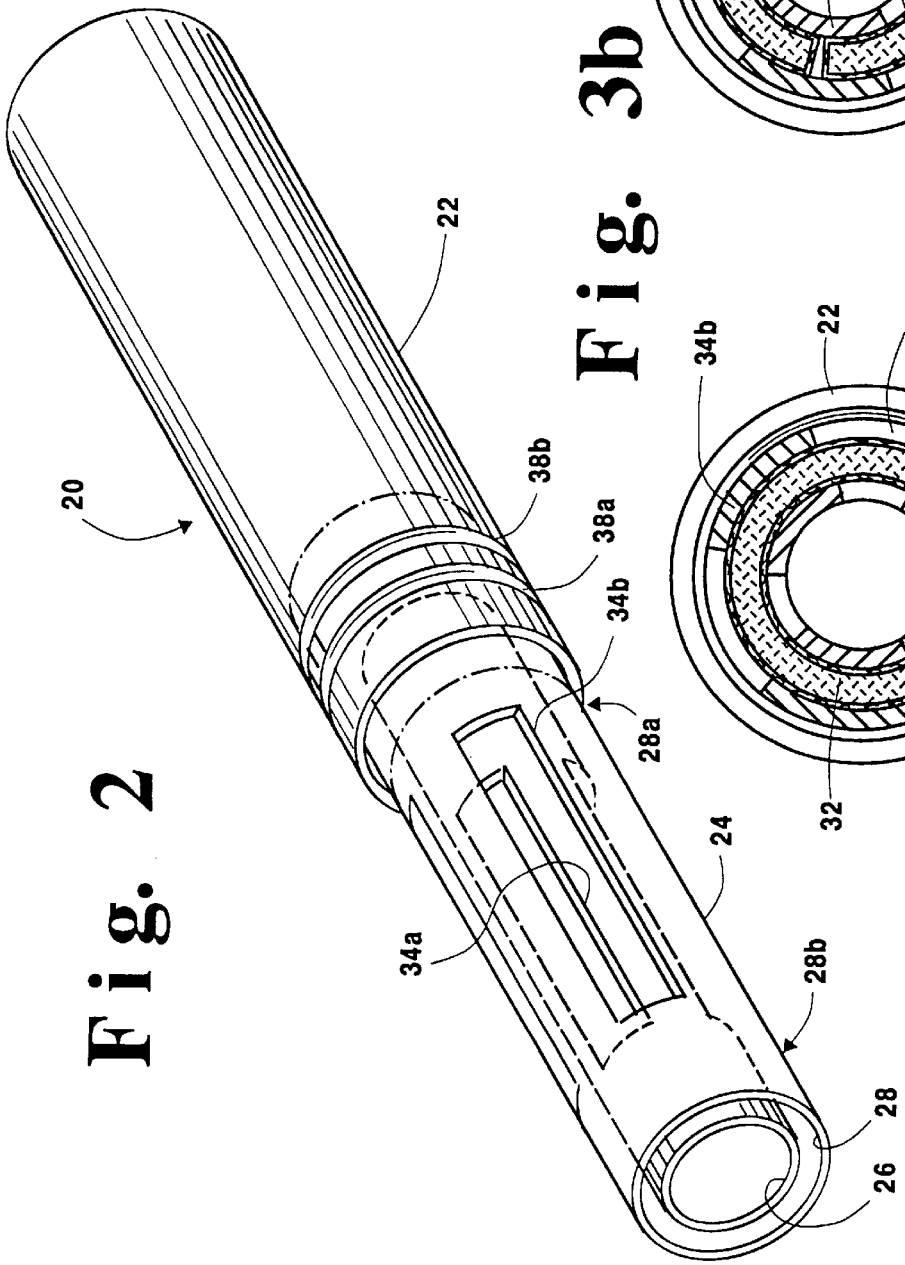
FIG. 2 is a perspective view of the beverage infusion device illustrating the device without the porous pouches in place.

The beverage infusion device 20 may be made of cardboard, plastic or any suitable material. The infusible beverage substance 32 may be coffee or tea or the like. The outer wall 28 has a plurality of outer infusion openings 34*b* to facilitate a cross-flow of a liquid (not shown) through the region between the walls and through the porous pouch 30. Further, in the preferred embodiment, the inner wall 26 has a plurality of inner infusion openings 34*a*. The inner infusion openings 34*a* cooperating with the outer infusion openings 34*b*, as shown in FIG. 2, to facilitate cross-flow of the liquid through the porous pouch 30. FIG. 3 further illustrates the cooperation between three inner infusion opening 34*a* and three outer infusion openings 34*b*.

Figure 4:
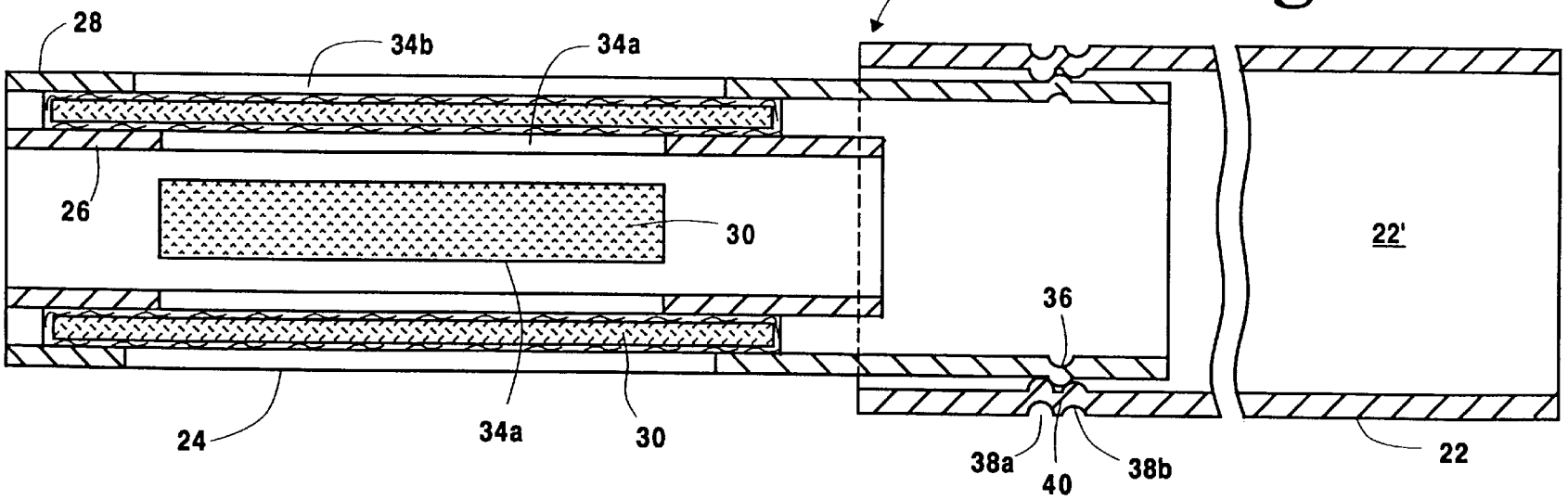
FIG. 4 is a cross sectional view of the beverage infusion device illustrating the placement of the flange and detents.
Figure 9:
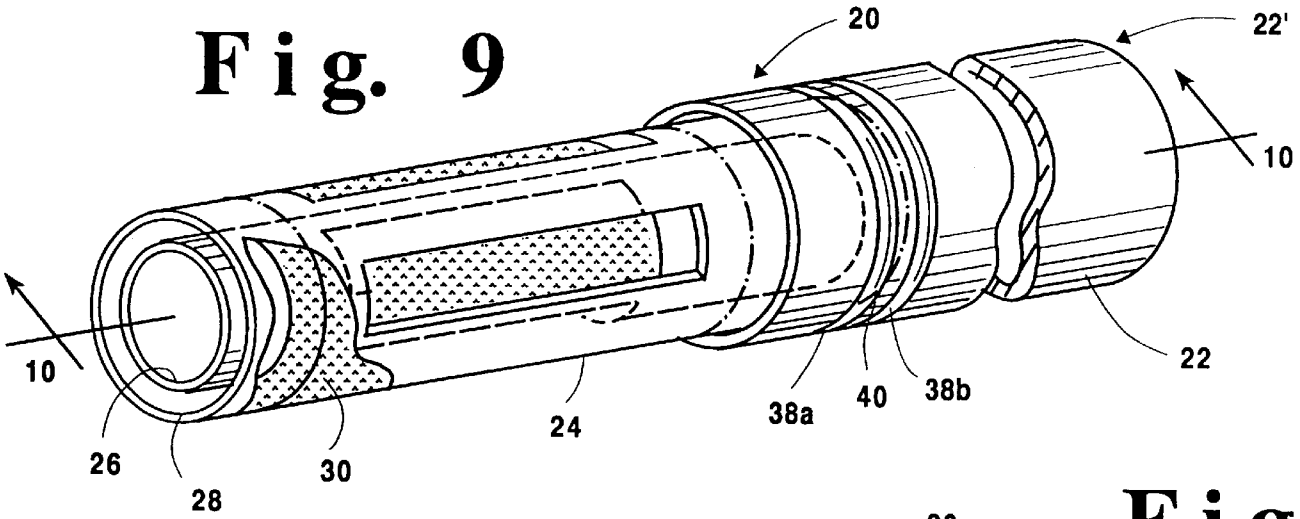
FIG. 9 is a perspective view of the beverage infusion device illustrating porous pouches in cooperation with only a portion of the infusion openings.
Figure 10:
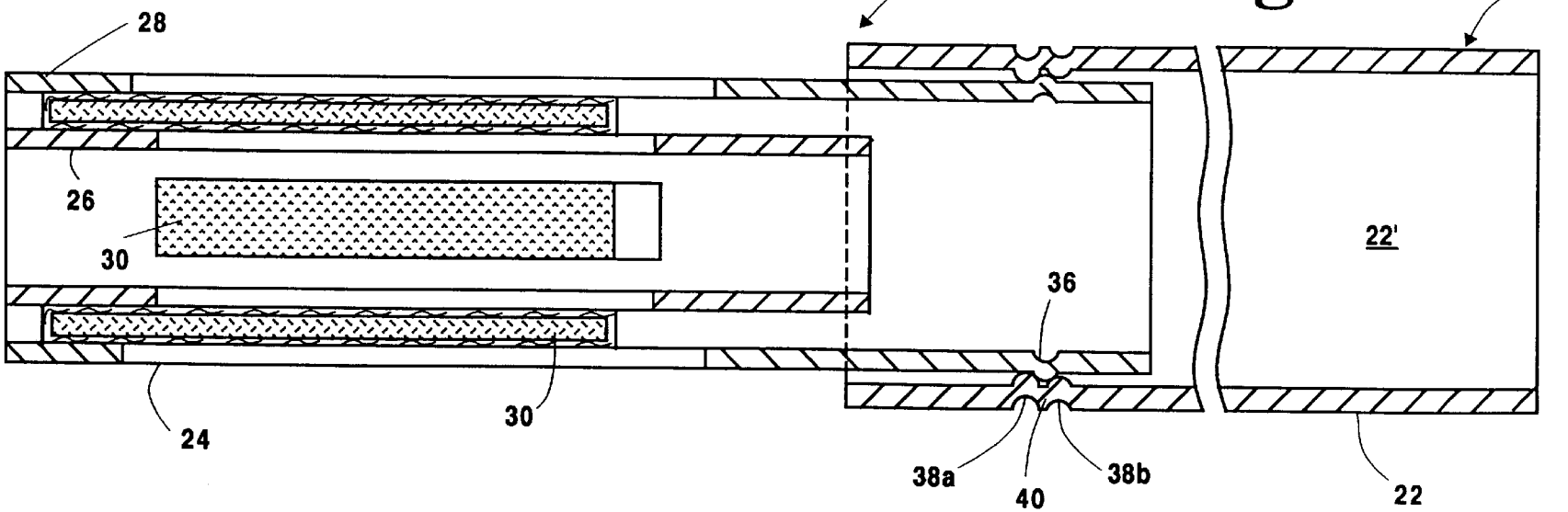
FIG. 10 is a cross sectional view of the beverage infusion device illustrating porous pouches in cooperation with only a portion of the infusion openings.

In the preferred embodiment, the infusion openings 34 and the porous pouches 30 are rectangular as illustrated in FIG. 3; however the pouch could be formed of other suitable shapes. The pouches 30 are in cooperation with the rectangular infusion openings 30*b* as shown in FIG. 1. The pouches 30 do not necessarily have to cooperate with the infusion openings 34*a,b* and may be in cooperation with only a portion of the infusion openings 34*a,b* as illustrated in FIGS. 9–10. In another embodiment, shown in FIG. 3*a* one pouch 30, substantially annularly shaped is positioned between the inner wall 26 and the outer wall 28 of the body. Further the pouch could be substantially rectangularly shaped as shown in FIG. 3*b*. While the infusion openings of FIGS. 1, 2, and 4 are rectangular, infusion openings of other shapes including, but not limited to, circular, oval or square are also appropriate so long as the geometry of the infusion opening allows for cross-flow of liquid through the porous pouch. The pouch 30 is made of a porous material which is pervious to liquid such as water. The porous material is known to one of ordinary skill in the art.

Figure 11:
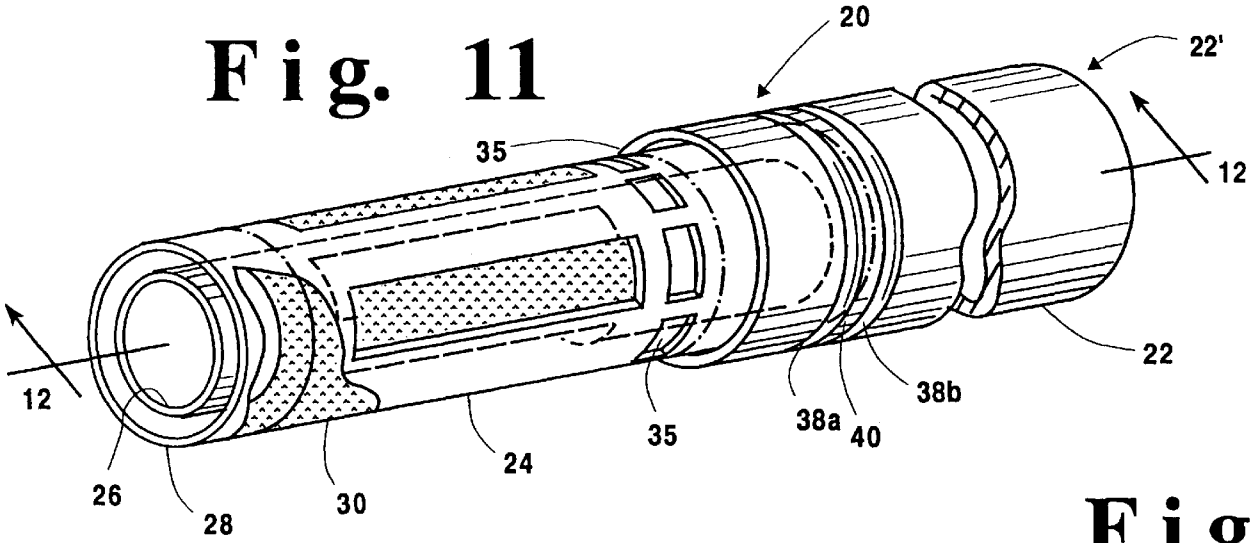
FIG. 11 is a perspective view of the beverage infusion device with flow openings on the inner and outer walls.
Figure 12:
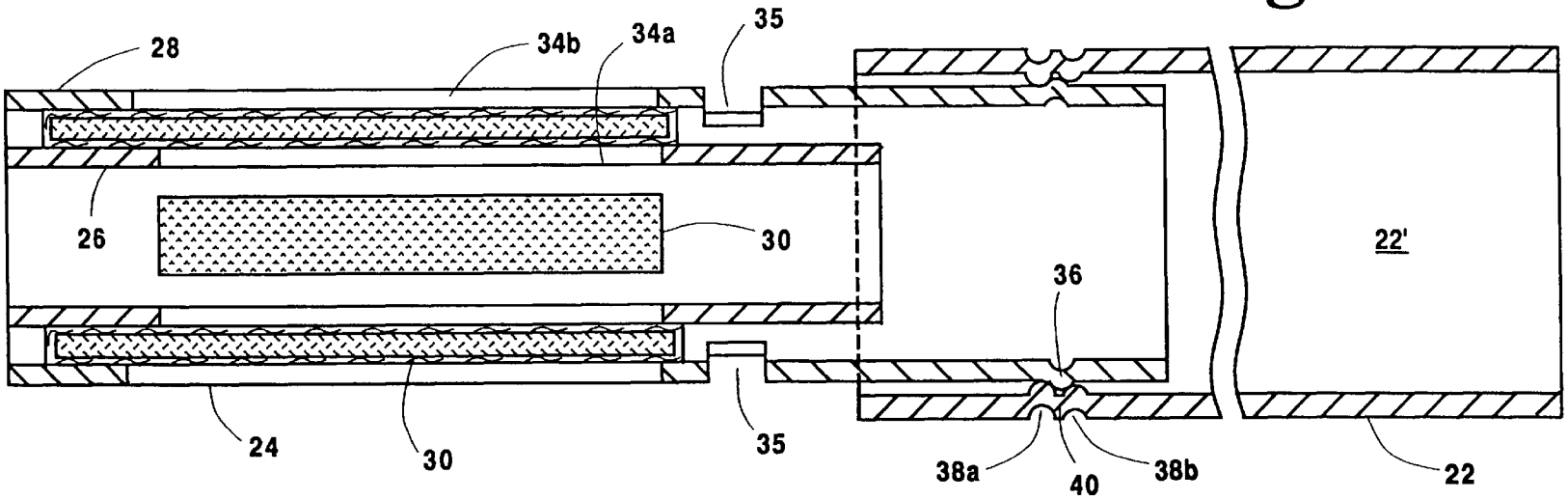
FIG. 12 is a cross sectional view of the beverage infusion device with flow openings on the inner and outer walls.

FIGS. 11–12 illustrate the beverage infusion device 20 which may also include a plurality of inner flow openings 35 on the inner wall 26 and a plurality of outer flow openings 35*b* on the outer wall 28. The inner flow openings 35*a* cooperate with the outer flow openings 35*b* in order to facilitate the flow of liquid through the openings 35*a,b*. The openings 35*a,b* are shown as rectangles but may be of other appropriate shapes including circular, oval or square, provided the shape allow for a flow of liquid through the openings 35*a,b*.

As shown in FIG. 4, the outer wall 28 has first and second ends 28*a,b*, a flange 36 is formed near the first end of the outer wall. The handle 22 has first and second ends 22*a,b*. First and second detents 38*a,b* are positioned near the handle first end 22*a* and define a space 40 between the detents 38*a,b*. The first detent 38*a* is deeper than the second detent 38*b*. When the device is in an extended position, the flange 36 rests in the space 40 between the first and second detents 38*a,b* prohibiting inadvertent disengagement of the body 24 from the handle 40. The beverage infusion device of FIG. 1 can also be used to stir a beverage. The device 20 can be closed (not shown) for easy packaging and disposal, whereby the handle 22 receives the body 24.

Figure 3D:
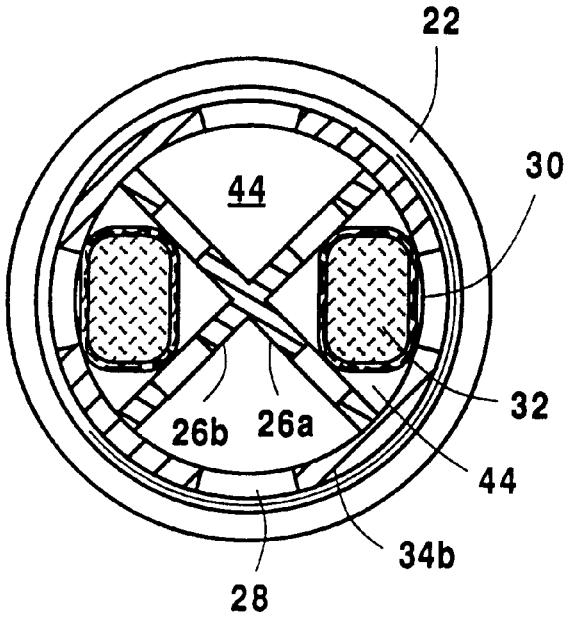
FIG. 3*d* is a cross-sectional view of the beverage infusion device, along line 3—3 of FIG. 1, illustrating an embodiment with intersecting inner walls and diametrically opposed porous pouches.

Alternately, as shown in the cross-sectional FIG. 3*d*, the beverage infusion device 20 has intersecting first and second inner walls 26*a,b* defining chambers 44. The porous pouches 30 can be positioned in diametrically opposed chambers, preferably in two diametrically opposed chambers 44. The first and second inner walls 26*a,b* have a plurality of inner infusion openings 34*a* which are shaped as described above.

The beverage infusion device 20 described above may be carried compactly by a user when the device is in the closed position. In the extended position the device may be used to make an infused beverage, such as coffee or the like, by submersing the body portion 24 of the device 20 into a drink container which is holding hot liquid. The handle 22 of the device may be gripped by the user or the device my rest in the edge of the container. The user may stir the liquid with the device by gripping the handle and performing a stirring motion. Once the liquid has reached a desired state of infusion, the user may add other substances such as cream or sugar and may use the device 20 to stir the beverage. The user may also remove the device from the liquid and push the handle into the closed position. When the device is fitted with a plunger, the closing motion will force out liquid from the core. The compact device is then situated for tidy, substantially drip free disposal.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A beverage infusion device comprising:

a handle;

a body having a first end and a second end, comprising at least one inner wall surrounding a core and an outer wall, said body connected to said handle at said first end;

said inner wall and said outer wall defining a region therebetween for an infusible beverage substance, said region defining an opening at said second end of said body; and, said outer wall having a plurality of outer infusion openings to facilitate a cross-flow of a liquid through said region between said inner and outer walls.

2. The beverage infusion device of claim 1 wherein said body is movably disposed with respect to said handle.

3. The beverage infusion device of claim 1 wherein said body is slideably connected to said handle.

4. The beverage infusion device of claim 1 wherein said handle has a bore therethrough.

5. The beverage infusion device of claim 1 wherein said handle includes a plunger having first and second ends and being movably received at said first end in said body inner wall and axially aligned with said core in said body for facilitating removal of liquid from said beverage infusion device.

6. The beverage infusion device of claim 1 further comprising a porous pouch for holding said infusible beverage substance within the region between said inner and outer walls.

7. A beverage infusion device comprising a plunger and a body:

said plunger having a side wall, a plunger top portion, and a plunger bottom portion, such that said plunger top portion has an opening and a cross-sectional area greater than said plunger bottom portion;

said plunger bottom portion caps said side wall such that liquids are expelled by said plunger when said plunger is inserted into said body;

said body having a body top portion and a body bottom portion, comprising:

at least one inner wall surrounding a core; and, an outer wall;

said inner wall and said outer wall defining a region there between for an infusible beverage substance, said inner wall having a cross-section adaptable for receiving said plunger bottom portion, said body top portion having at least one opening in said region defined between said inner wall and said outer wall for receiving said infusible beverage substance, said inner wall and said outer wall having a plurality of infusion openings to facilitate cross-flow of a liquid through said region between said inner and outer walls; and, means for securing said plunger to said top portion of said body such that said plunger functions as a handle.

8. The beverage diffusion device of claim 7 wherein said plunger has a cross-sectional area and shape approximately equal to said region defined by said inner wall such that said plunger side walls press against said inner wall to expel liquid when said plunger is inserted within said body.

9. The beverage diffusion device of claim 7 wherein said plunger and said region defined by said inner wall are substantially circular, triangular, rectangular, octagonal, square, or elliptical in cross-section.

10. A beverage infusion device comprising:

a handle;

a body comprising at least one inner wall surrounding a core and an outer wall, said body connected to said handle;

said inner wall and said outer wall defining a region therebetween for an infusible beverage substance;

said outer wall having a plurality of outer infusion openings to facilitate a cross-flow of a liquid through said region between said inner and outer walls; and, said handle having a plunger, said plunger having first and second ends and being movably received at said first end in said body inner wall and axially aligned with said core in said body for facilitating removal of liquid from said beverage infusion device.

* * * * *

UNITED STATES PATENT AND TRADEMARK OFFICE

CERTIFICATE OF CORRECTION

PATENT NO. : 5,996,473

DATED : December 7, 1999

INVENTOR(S) : Milone

It is certified that error appears in the above-identified patent and that said Letters Patent is hereby corrected as shown below:

In Abstract, Line 11, delete "the rectangular" and substitute therefore --said rectangular--.

Col. 1, Line 31 insert --are-- after which.

Col. 4, Line 43, delete "pouch" and substitute therefore - -pouches- -

Col. 5, Line 31, delete "my" and substitute therefore- - may- -

Signed and Sealed this

Fifth Day of September, 2000

*Attest:*

*Attesting Officer*

Q. TODD DICKINSON

*Director of Patents and Trademarks*